US008186534B2

(12) United States Patent
Apps

(10) Patent No.: US 8,186,534 B2
(45) Date of Patent: May 29, 2012

(54) STACKABLE LOW DEPTH TRAY

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 94 days.

(21) Appl. No.: 12/795,015

(22) Filed: Jun. 7, 2010

(65) Prior Publication Data

US 2010/0307949 A1 Dec. 9, 2010

Related U.S. Application Data

(60) Provisional application No. 61/184,768, filed on Jun. 5, 2009.

(51) Int. Cl.
*B65D 1/24* (2006.01)
*B65D 1/36* (2006.01)

(52) U.S. Cl. ..... 220/515; 220/516; 206/509

(58) Field of Classification Search ..... 220/509, 220/513, 515, 516; 206/203, 427, 509
See application file for complete search history.

(56) References Cited

U.S. PATENT DOCUMENTS

| | | | | |
|---|---|---|---|---|
| 4,978,002 | A * | 12/1990 | Apps et al. | 206/201 |
| 5,419,451 | A | 5/1995 | Bitel, Jr. | |
| 5,740,934 | A * | 4/1998 | Brady | 215/381 |
| 2003/0029870 | A1 | 2/2003 | Apps et al. | |
| 2008/0116214 | A1 * | 5/2008 | Apps et al. | 220/737 |
| 2009/0206088 | A1 * | 8/2009 | Ogburn | 220/516 |
| 2009/0242568 | A1 * | 10/2009 | Apps | 220/516 |

FOREIGN PATENT DOCUMENTS

| | | | |
|---|---|---|---|
| EP | 2 090 516 | A1 | 8/2009 |
| WO | 94/08862 | A1 | 4/1994 |
| WO | 2008/063803 | A1 | 5/2008 |

OTHER PUBLICATIONS

Photograph of Pepsi—Blue Crate, Top View.
Photograph of Pepsi—Blue Crate, Bottom View 1.
Photograph of Pepsi—Blue Crate, Bottom View 2.
Photograph of Norseman NPL 405 Crate, Top View.
Photograph of Norseman NPL 405 Crate, Bottom View.
Photograph of Coca Cola Crate, Top View.
Photograph of Coca Cola Crate, Bottom View.
Photograph of 2L Coca Cola "Tulip" Crate, Top View.
Photograph of 2L Coca Cola "Tulip" Crate, Bottom View 1.
Photograph of 2L Coca Cola "Tulip" Crate, Bottom View 2.
Photograph of 2L Coca Cola "Tulip" Crate, Bottom View 3.
European Search Report for EP Application No. 10165153.7, Sep. 24, 2010.

* cited by examiner

*Primary Examiner* — Harry Grosso
(74) *Attorney, Agent, or Firm* — Carlson, Gaskey & Olds

(57) ABSTRACT

A tray includes a base, a pair of opposed side walls extending along side edges of the base and a pair of opposed end walls extending along end edges of the base. A central lateral divider extends between the side walls. The central lateral divider has a width approximately twice a width of the side walls to permit cross stacking. The central lateral divider includes a pair of spaced-apart divider walls and at least one center rib between the divider walls.

24 Claims, 11 Drawing Sheets

STACKABLE LOW DEPTH TRAY

This application claims priority to U.S. Provisional Application Ser. No. 61/184,768, filed Jun. 5, 2009.

BACKGROUND OF THE INVENTION

The present invention relates to a stackable low depth tray for storing and transporting beverages containers, such as bottles.

Plastic bottles are widely used as containers for soft drinks and other beverages. These bottles are often stored and transported in trays, particularly plastic trays. There are many known tray designs that are referred to as "low depth" trays in which the side and end walls are lower than the height of the stored bottles, and in which the bottles support the weight of additional trays and bottles stacked thereon.

SUMMARY

The present invention relates to a stackable low depth tray for storing and transporting beverages containers, such as bottles.

A tray includes a base, a pair of opposed side walls extending along side edges of the base and a pair of opposed end walls extending along end edges of the base. A central lateral divider extends between the side walls. The central lateral divider has a width approximately twice a width of the side walls to permit cross stacking. The central lateral divider includes a pair of spaced-apart divider walls and at least one center rib between the divider walls.

Each end wall may include a hollow end column having an outer wall flaring laterally outwardly to define a handle and then longitudinally outwardly to form a lip at the lowermost edge of the handle.

Each side wall may include hollow side columns. The tray may include corner columns at corners of the tray, and an upper bar and a lower bar connecting adjacent pairs of the side columns and connecting side columns to corner columns.

DETAILED DESCRIPTION OF THE PREFERRED EMBODIMENT

Figure 1:
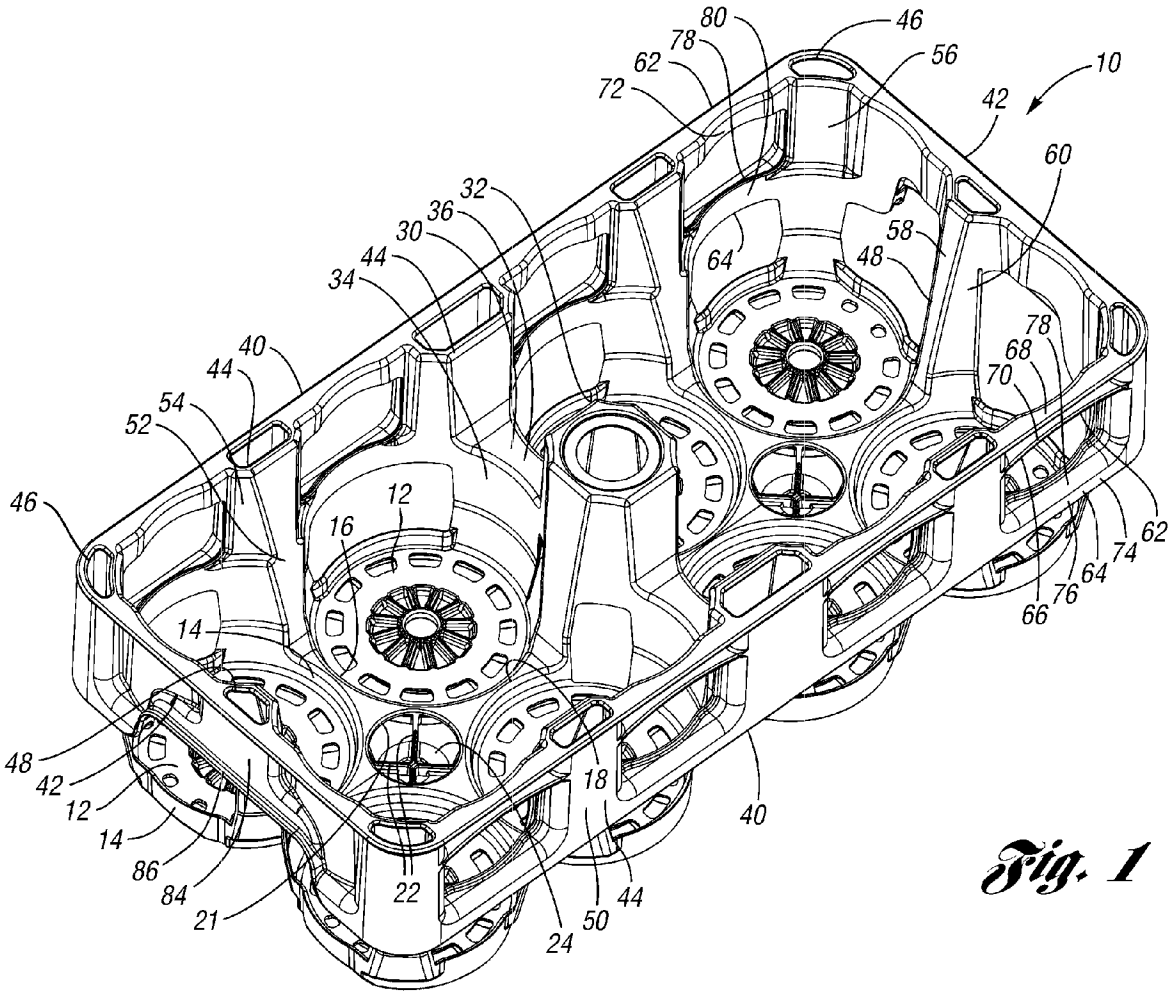
FIG. 1 is a perspective view of a tray according to one embodiment of the present invention.

A tray 10 according to one embodiment of the present invention is shown in FIG. 1. The tray 10 includes a plurality (in this example, eight) of spaced apart base walls 12, each having a short peripheral wall 14 defining a bottle-receiving pocket therein. Adjacent pairs of portions of the peripheral walls 14 define lateral dividers 16 and longitudinal dividers 18. Between each group of four pockets the lateral dividers 16 and longitudinal dividers 18 define a spacer 20 having an upper surface with a relatively large opening 21 therethrough. Ribs 22 perpendicular to one another extend downward and across the opening between the pockets and the peripheral walls 14 down to a lower platform 24.

A center lateral divider 30 divides the bottle pockets into two groups of four, where the groups are spaced apart from one another by a width equal to twice the width of the outer wall of the tray 10, such that loaded trays 10 could be cross-stacked with the bottles aligned. A central column 32 projects upwardly from the center of the center lateral divider 30. The central column 32 is generally the same height as the side walls 40 and end walls 42. The center lateral divider 30 includes a generally horizontal upper wall 36 and a pair of spaced-apart divider walls 34, each partially defining an adjacent pocket.

The tray 10 includes side walls 40 and end walls 42. The central column 32 is generally the same height as the side walls 40 and end walls 42. The side walls 40 include hollow side columns 44 formed along sides of the tray 10. Corner columns 46 are formed at the corners of the tray 10. End columns 48 are formed at ends of the tray 10. The side columns 44 each include an outer wall 50 partially defining an outer surface of the side wall 40 and an inner wall 52, spaced inwardly from the outer wall 50. Angled walls 54 lead to the inner wall 52 and partially define the bottle-receiving pockets.

Similarly, end columns 48 include an outer wall 84, inner wall 58 and angled walls 60 that partially define the bottle-receiving pockets. Corner columns 46 include an outer wall spaced outwardly from an inner wall 56 that partially defines bottle-receiving pockets.

The side walls 40 further include an upper bar 62 and a lower bar 64 connecting adjacent side columns 44 and connecting side columns 44 to corner columns 46. The upper bar 62 and lower bar 64 are spaced apart to define a window adjacent each bottle-receiving pocket to provide visibility to the bottle label. The upper bar 62 includes an upper horizontal rib 68, which extends around the entire periphery of the tray 10. Each upper bar 62 further includes a lower horizontal rib 70 and an inner wall 72 from which the upper and lower horizontal ribs 68, 70 project outwardly. As shown, each upper bar 62 opens outwardly from the tray 10.

Each lower bar 64 includes an outer wall 76 and an inner wall 80 extending downwardly from an upper wall 78. Thus, the lower bar 64 opens downwardly and provides a smooth exterior surface while the vertically oriented outer wall 76 and inner wall 80 of the lower bar 64 provide rigid reinforcement along the longitudinal axis of the tray 10. The inner wall 80 is concave facing inwardly to further define a bottle-receiving pocket. The outer walls 50 of the side columns 44 do not extend below the lower bar 64, to define a lower portion (roughly half) of the tray 10, which is narrower than the upper portion of the tray 10.

The end walls 42 include the end columns 48, which have outer walls 84, which flare laterally outwardly as they extend downwardly. Each outer wall 84 then flares longitudinally outwardly to form a lip at its lowermost edge where a handle 86 is defined.

Figure 2:
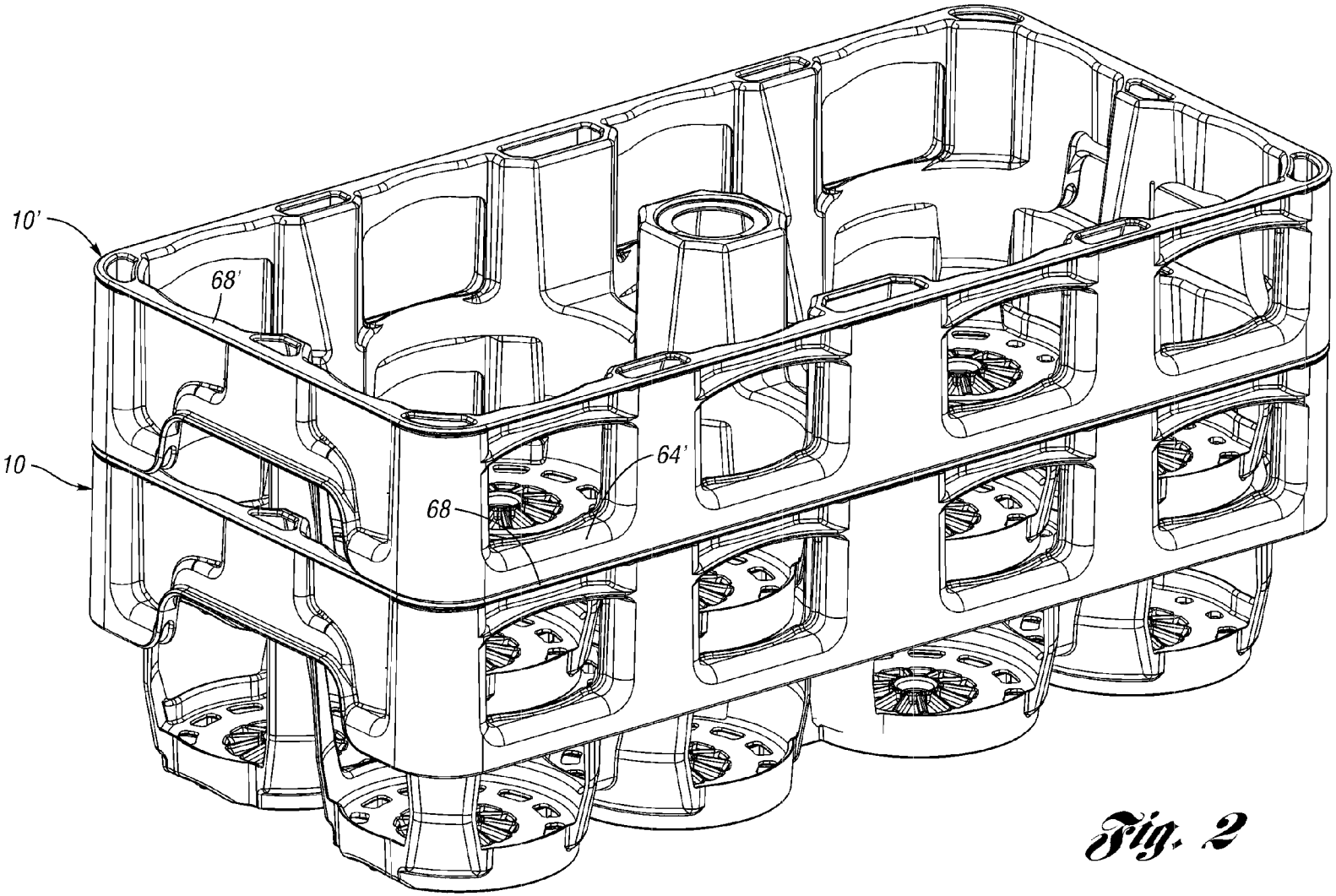
FIG. 2 is a perspective of the tray stacked on a similar tray.

FIG. 2 illustrates the tray 10 of FIG. 1 with a similar tray 10' nested therein. When nested, the lower portion of the upper tray 10' is received within the upper portion of the side walls 40 and end walls 42 of the lower tray 10.

Figure 3:
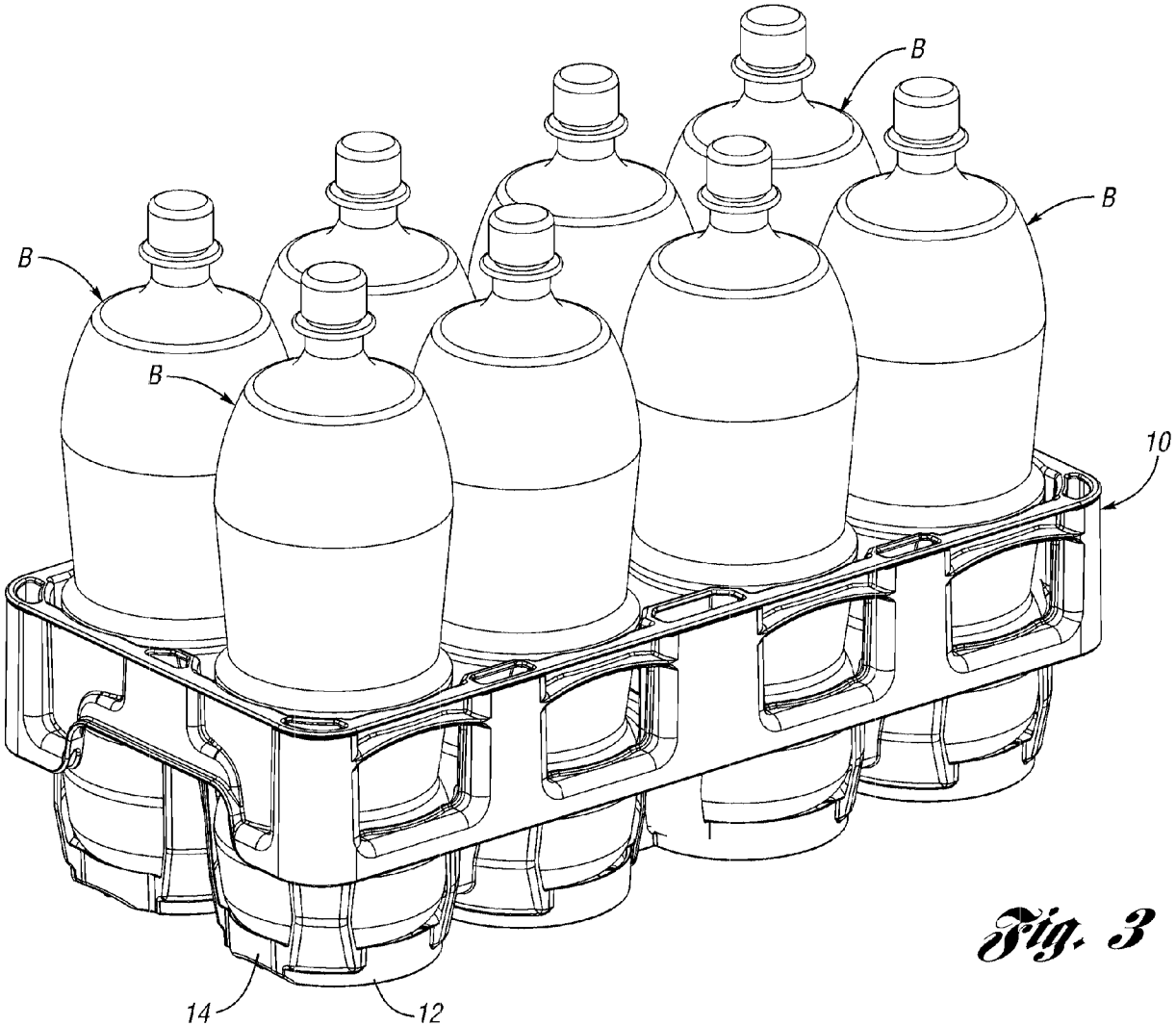
FIG. 3 shows the tray of FIG. 1, loaded with bottles.

FIG. 3 illustrates the tray 10 loaded with bottles B in the bottle-receiving pockets. The bottles B are large, multi-serving plastic beverage containers, for example 2-liter soft drink bottles.

Figure 4:
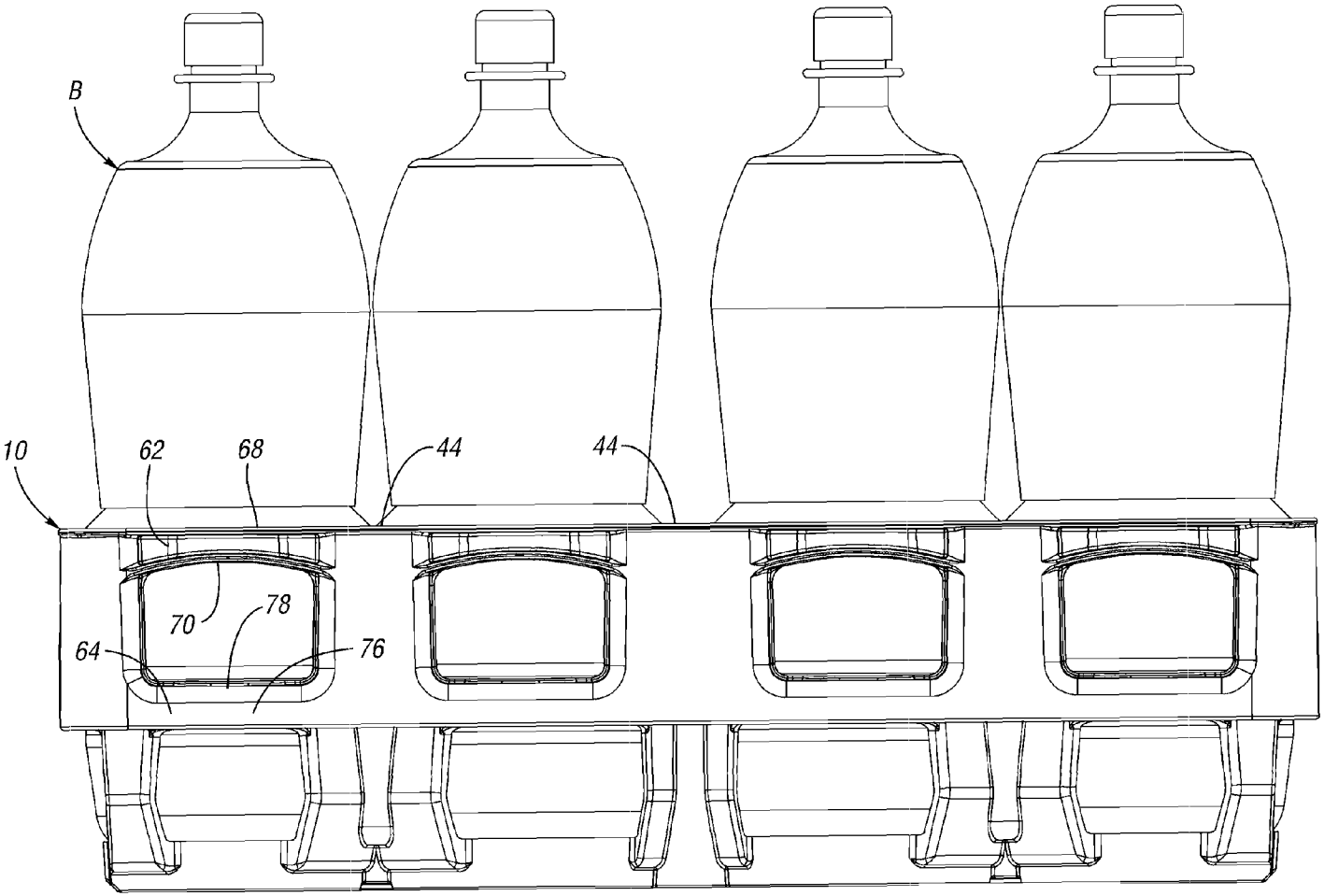
FIG. 4 is a side view of the tray and bottles of FIG. 3.

FIG. 4 is a side view of the tray 10 and bottles B. The lower horizontal rib 70 is formed as an arch over the window, thus further improving the visibility of a label (not shown) on the bottle B, while maintaining the strength and rigidity of the tray 10. As shown, the bottles B within each group of 2×2 bottles B are touching, which contributes to the rigidity of the tray 10 (or very near touching, such that any deflection of the tray 10 will cause them to touch and resist further deflection). Longitudinally, carrying the loaded tray 10 places a lot of stress on the middle of the tray 10 between the two groups of 2×2 bottles.

Figure 5:
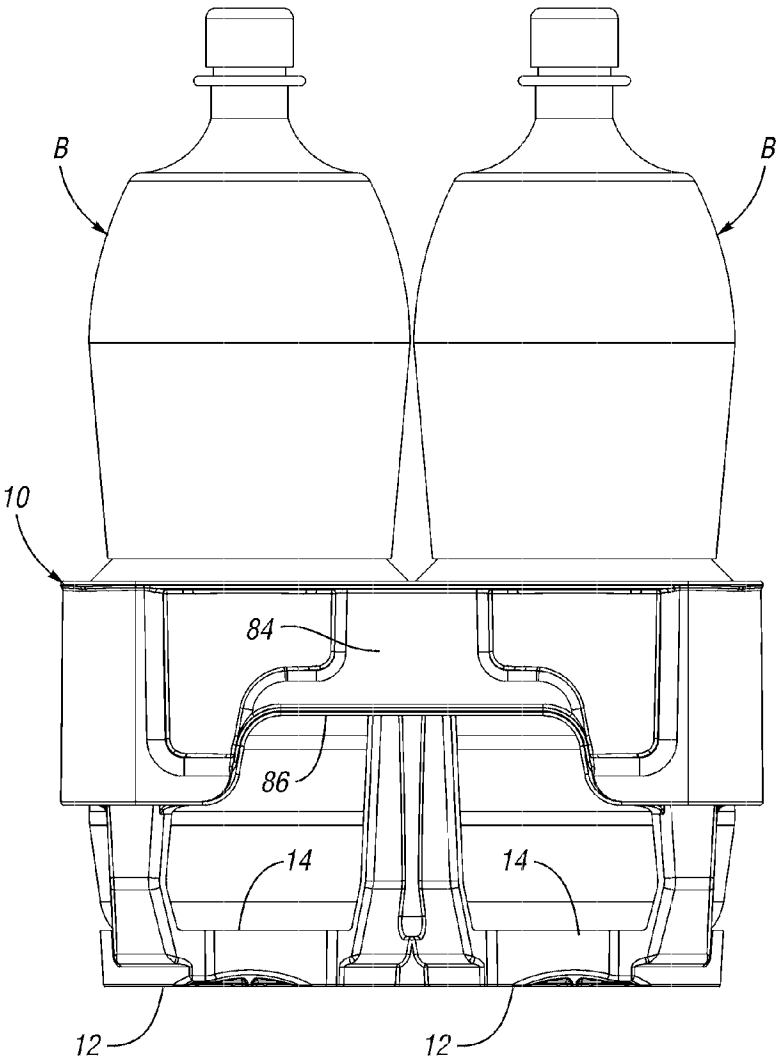
FIG. 5 is an end view of the tray and bottles.

FIG. 5 is an end view of the tray 10 and bottles B.

Figure 6:
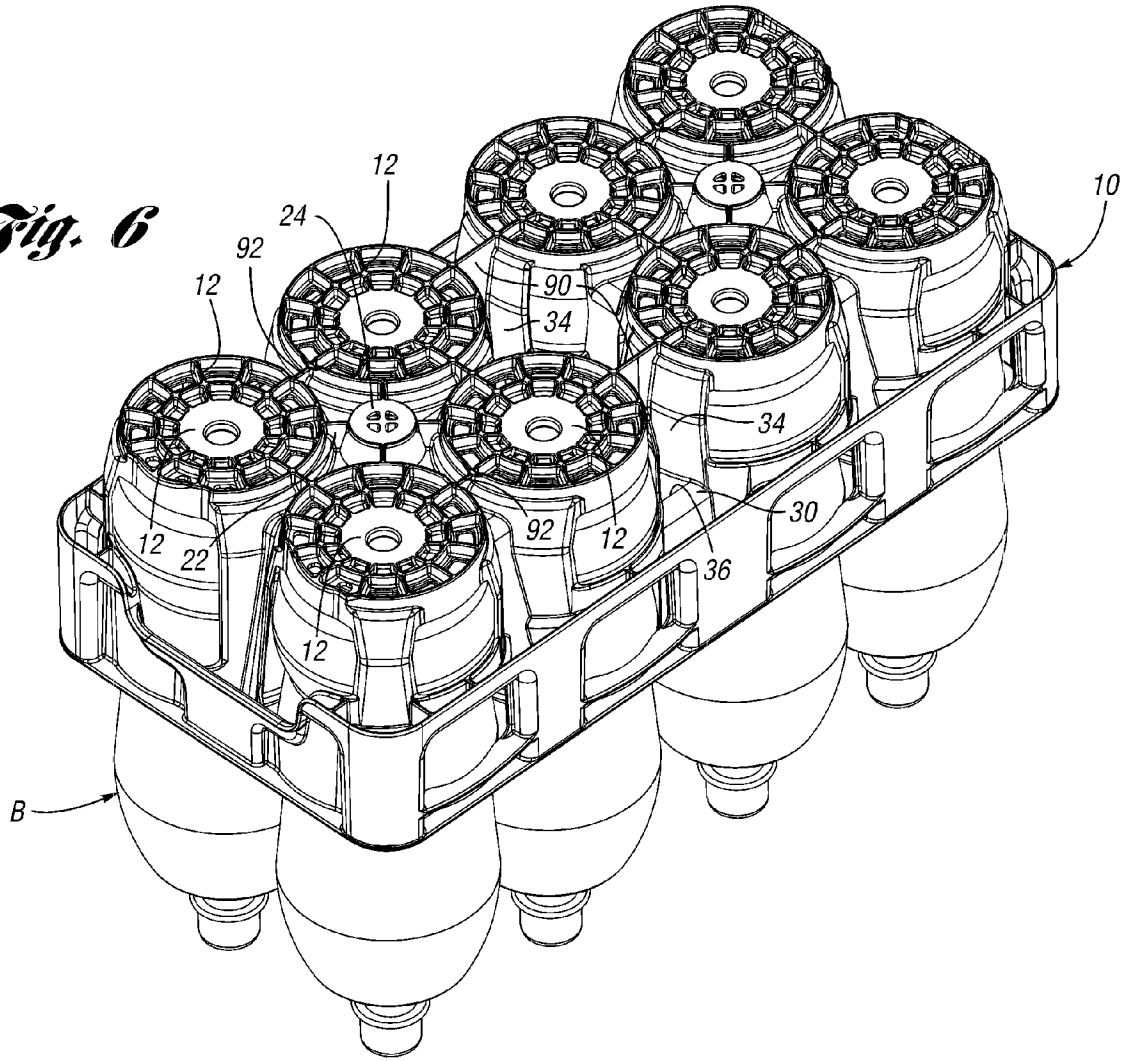
FIG. 6 is a bottom perspective view of the tray and bottles.

FIG. 6 is a bottom perspective view of the tray 10 and bottles B. The center of each of the base walls 12 includes a recessed cap-receiving area to provide stable stacking of loaded trays 10. In order to facilitate sliding a loaded tray on top of the bottles of another tray (after initially overcoming the resistance of moving the recessed cap-receiving area off the caps of the bottles of the lower tray), several features are provided. First, the lower platform 24, which is rigidly and reliably connected to the base walls 12 and associated peripheral walls 14, inhibits caps of lower bottles from becoming stuck in the recess between the base walls 12 in each 2×2 group. Second, each base wall 12 is connected to an adjacent base wall 12 by a rib 92 that is coplanar with the bottom edges of the ribs of the base walls 12. The groups of 2×2 base walls 12 are connected by center ribs 90, which connect the divider walls 34 of the center lateral divider 30. The center ribs 90 also greatly increase the rigidity and integrity of the center lateral divider 30 and resist deflection of the tray 10 at the center lateral divider 30, particularly when the loaded tray 10 is carried by the handles 86.

Figure 7:
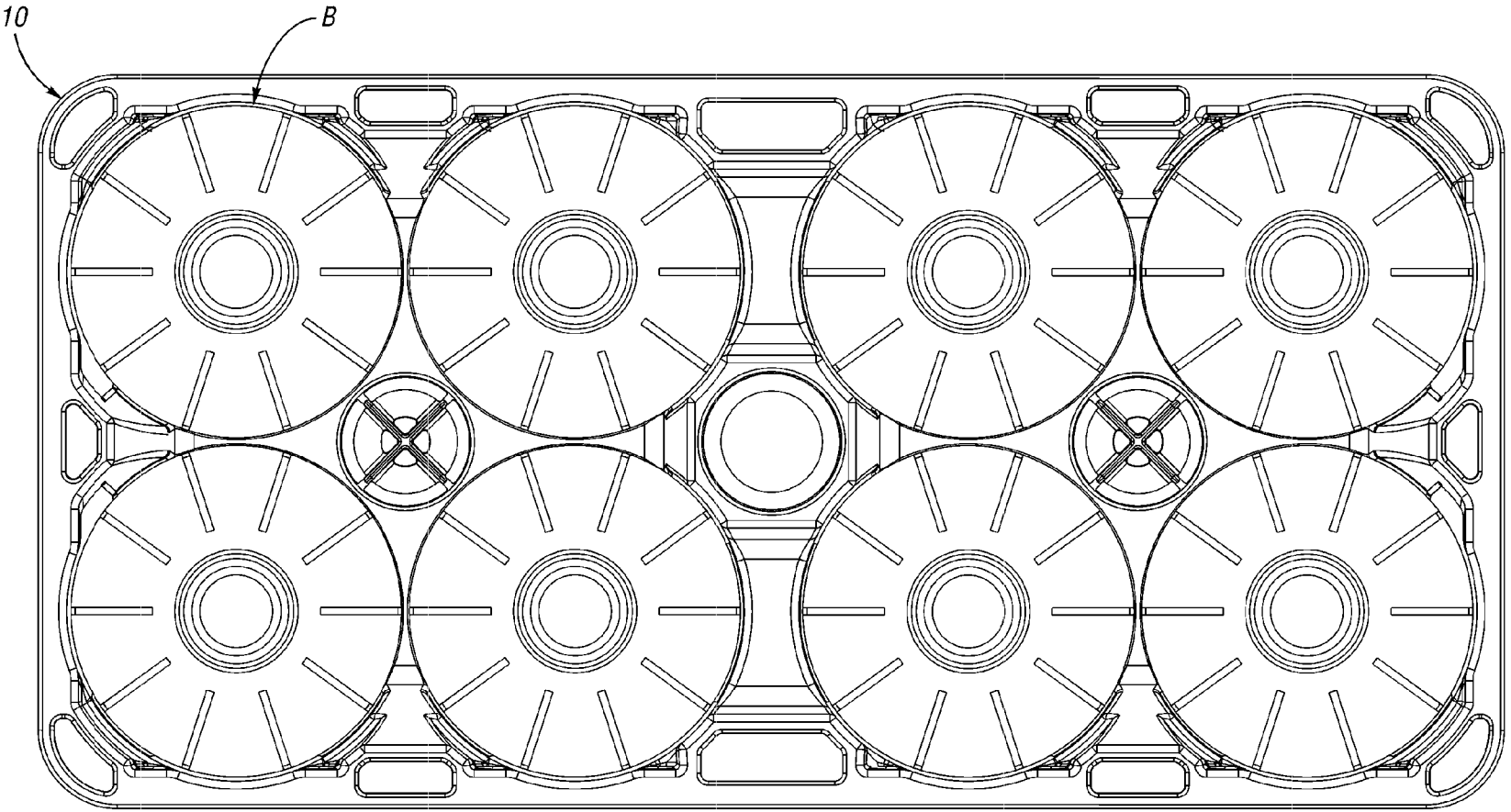
FIG. 7 is a top view of the tray and bottles.

FIG. 7 is a top view. As shown, the bottles within each 2×2 group are touching one another or close enough to be effectively so. The columns 32, 44 between the 2×2 groups prevent movement between the groups, e.g. such as by deflection of the tray 10 about the lateral centerline.

Figure 8:
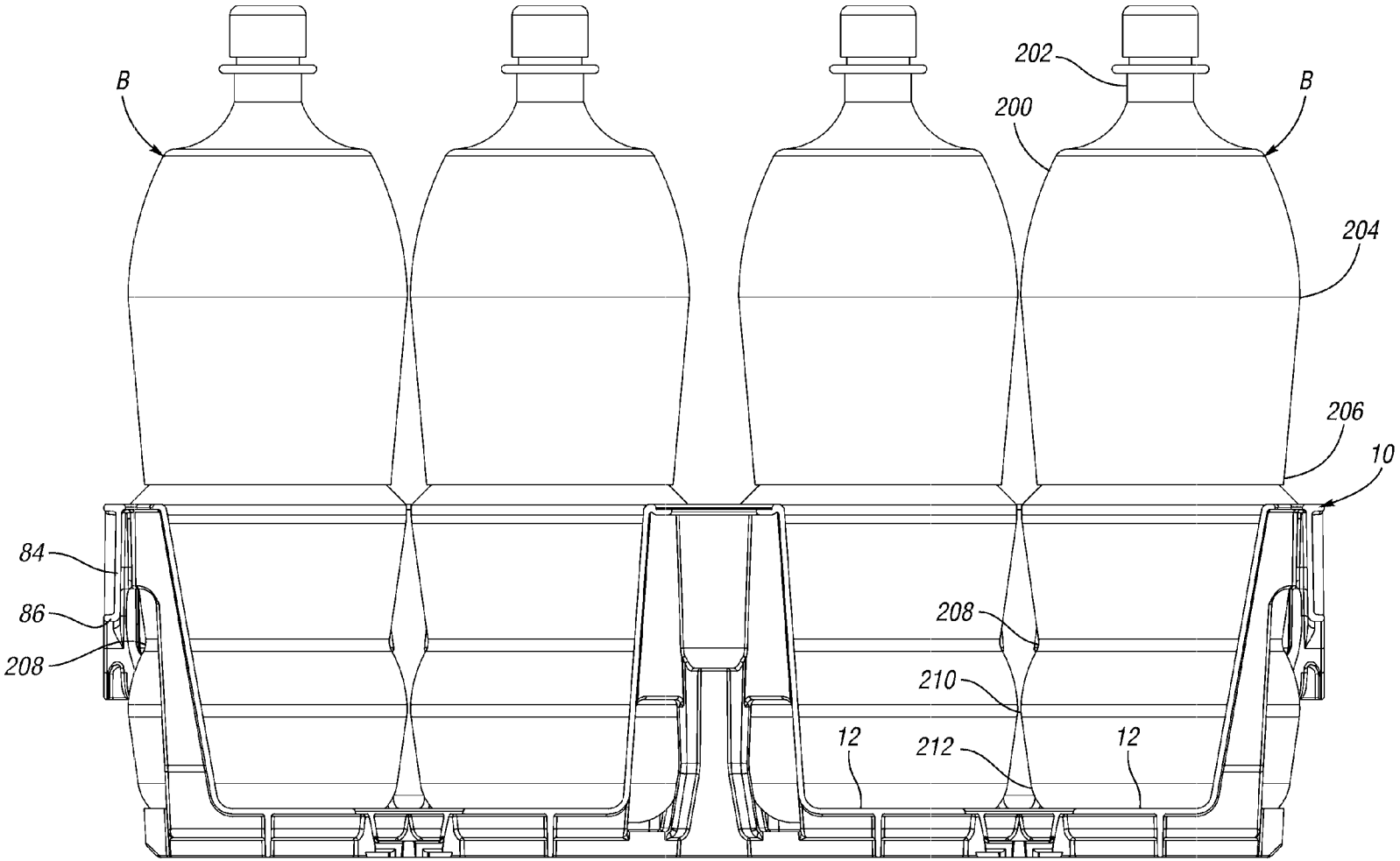
FIG. 8 is a section view taken along a longitudinal centerline of FIG. 7.

As shown in FIG. 8, the bottles B each have a body portion 200 and a neck portion 202. The body portion 200 expands outwardly from the neck portion 202 to upper large diameter portion 204, then tapers inwardly to an upper tapered portion 206, outwardly again to a middle large diameter portion, and then tapers inwardly to a lower tapered portion 208. The body portion 200 then expands outwardly to a base portion 210 and then tapers inwardly to a base of the bottle B.

The upper edge of the tray 10 and the upper edges of the columns 32, 44, 46, 48 are aligned at or just above the middle large diameter portion of the bottles B. The lower edge of the handle 86 is aligned with the lower tapered portion 208 of the bottles B and slightly above a narrowest diameter portion of the lower tapered portion 208 by approximately the width of a finger. This provides the maximum clearance for a person to grasp the handle 86 to carry the tray 10.

Figure 9:
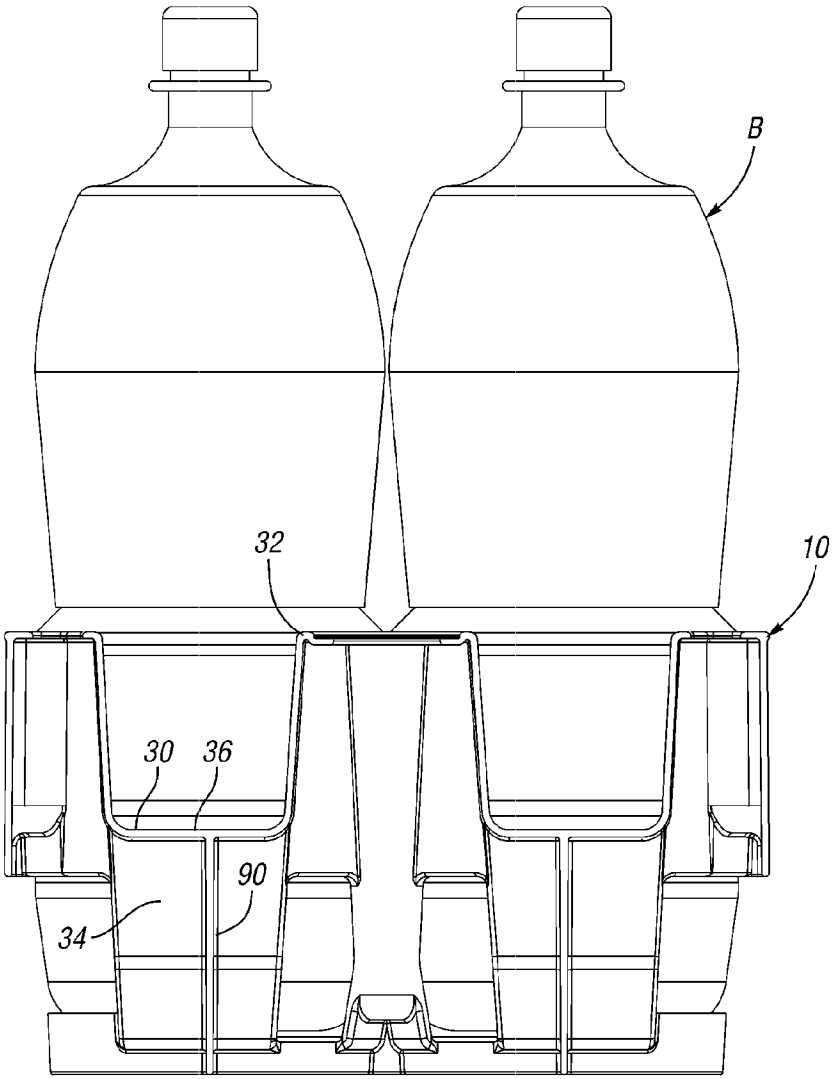
FIG. 9 is a section view taken along a lateral centerline of FIG. 7.

Referring to FIG. 9, the center ribs 90 connect the divider walls 34 of the center lateral divider 30 to connect the groups of 2×2 base walls 12. The center ribs 90 increase the rigidity and integrity of the center lateral divider 30 and resist deflection of the tray 10 at the center lateral divider 30, particularly when the loaded tray 10 is carried by the handles 86.

Figure 10:
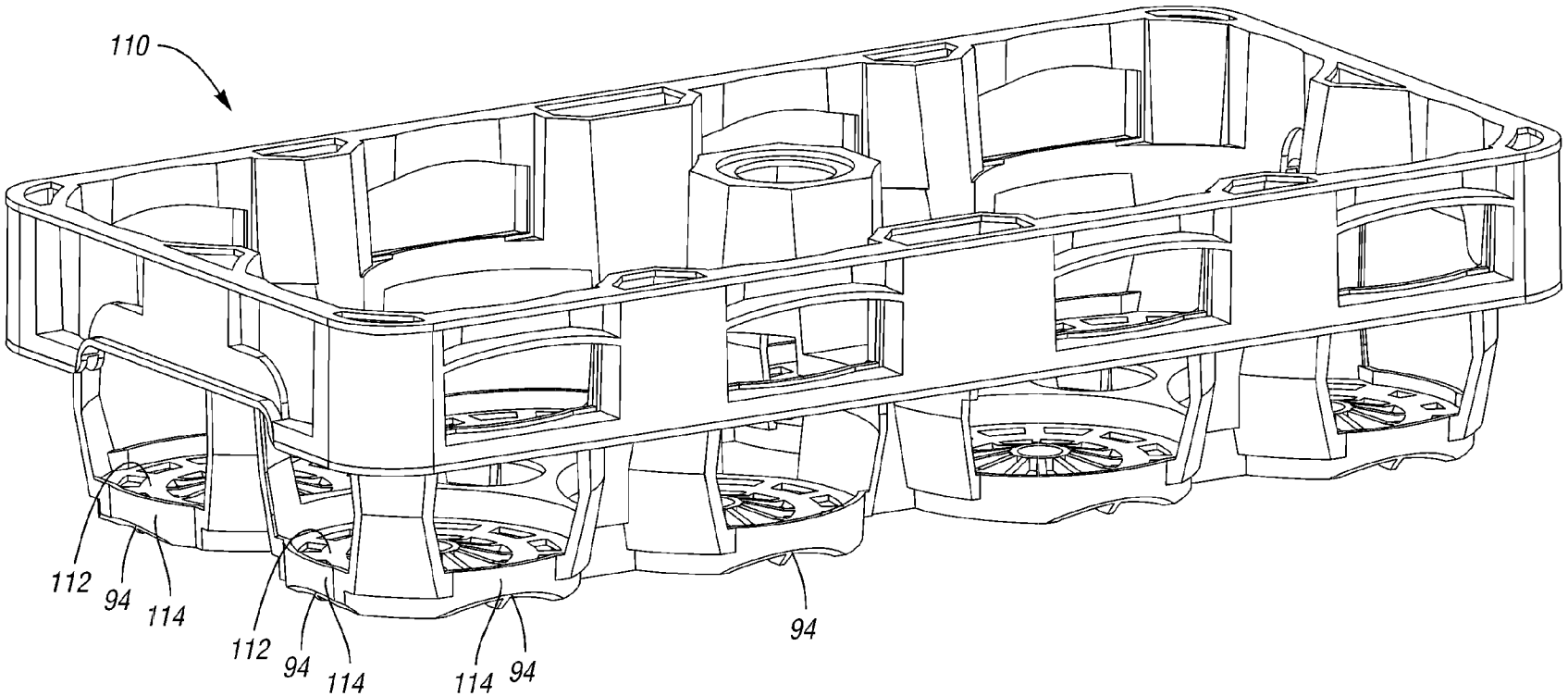
FIG. 10 is a perspective view of a tray according to a second embodiment of the present invention.
Figure 11:
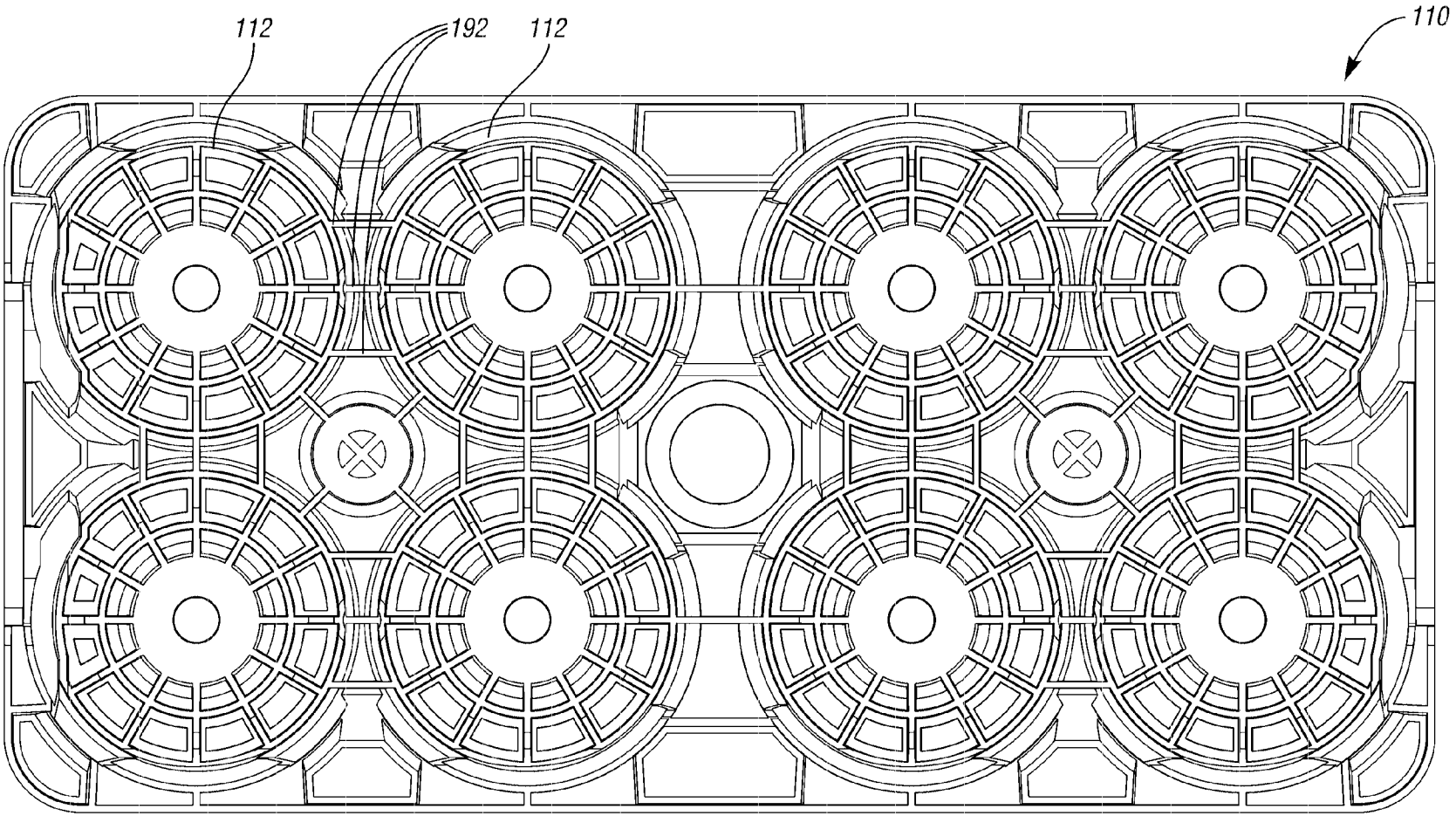
FIG. 11 is a bottom view of the tray of FIG. 10.

FIGS. 10 and 11 illustrate a tray 110 according to a second embodiment of the present invention. The tray 110 is identical to the tray 10 of FIGS. 1-9 except as shown or described. Again, the tray 110 includes a plurality (in this example, eight) of spaced apart base walls 112, each having a short peripheral wall 114 defining a bottle-receiving pocket therein. In the tray 110, the base walls 112 (including ribs on the underside) and the peripheral walls 114 include upwardly tapered portions 94 along the side edges and end edges of the tray 110. This provides clearance for automated handling equipment. The ribs of the base walls 112 are tapered upwardly to form the upwardly tapered outer edge.

Referring to FIG. 11, the base walls 112 include a plurality of ribs 192 that are coplanar with the bottom edges of the ribs of the base walls 112. The additional ribs 192 permit the tray 110 to twist and slide across the tops of bottles in trays stacked therebelow more easily.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A tray comprising:

a base;

a pair of opposed side walls extending along side edges of the base, wherein the side walls include hollow side columns;

a pair of opposed end walls extending along end edges of the base;

a plurality of corner columns, the side walls including an upper bar and a lower bar connecting adjacent pairs of the side columns and connecting side columns to corner columns;

a plurality of pockets defined on the base, each pocket for supporting a container; and a central lateral divider extending between the side walls, the central lateral divider having a width approximately twice a width of the side walls to permit cross stacking, the central lateral divider including a pair of spaced-apart divider walls and at least one center rib between the divider walls.

2. The tray of claim 1 further including a central column projecting upward from a center of the central lateral divider.

3. The tray of claim 2 wherein the side walls include hollow side columns and wherein the central lateral divider extends between two side columns.

4. The tray of claim 3 further including lateral dividers extending between hollow side columns on either side of the central lateral divider, and longitudinal dividers extending transversely to the lateral dividers from the central column.

5. The tray of claim 4, wherein intersections of the lateral and longitudinal dividers define spacers having an opening through a top wall thereof, wherein uppermost surfaces of the lateral and longitudinal dividers and the spacers are significantly lower than an uppermost surface of the central lateral divider.

6. The tray of claim 5 wherein the base includes a plurality of base walls each having a peripheral wall defining a container-receiving pocket therein, adjacent pairs of the peripheral walls of the base walls being spaced apart and defining the lateral and longitudinal dividers.

7. The tray of claim 6 further including hollow end columns in the end walls, the longitudinal dividers extending from the spacers to the end columns.

8. The tray of claim 7 further including ribs extending across the openings through the spacers, the ribs connecting the peripheral walls of the base walls.

9. The tray of claim 8 further including a platform at a bottom edge of the ribs.

10. The tray of claim 1 wherein the upper bar includes an inner wall from which an upper horizontal rib projects outwardly.

11. The tray of claim 10 wherein the upper bar further includes a lower horizontal rib projecting from the inner wall.

12. The tray of claim 11 wherein the lower horizontal rib is an arch.

13. The tray of claim 12 wherein the lower bar includes an outer wall and an inner wall extending downwardly from an upper wall.

14. The tray of claim 1 wherein each end wall includes a hollow end column having an outer wall flaring laterally outwardly to define a handle and then longitudinally outwardly to form a lip at the lowermost edge of the handle.

15. The tray of claim 14 further including a plurality of bottles in the tray, each bottle having a tapered portion between a bottle base and a bottle neck, wherein the lowermost edge of the handle is aligned with the tapered portions of the bottles, slightly above narrowest diameter portions of the tapered portions of the bottles.

16. The tray of claim 1 wherein the base includes an upwardly tapered outer edge.

17. The tray of claim 16 wherein the base includes a plurality of spaced-apart base walls, each having a plurality of ribs extending downward, and wherein the ribs of the base walls are tapered upwardly to form the upwardly tapered outer edge.

18. A tray in combination with a plurality of bottles, the tray comprising:

a base;

a pair of opposed side walls extending along lateral edges of the base;

a pair of opposed end walls extending along longitudinal edges of the base; and each end wall including a hollow end column having an outer wall flaring laterally outwardly to define a handle and then longitudinally outwardly to form a lip at the lowermost edge of the handle wherein each bottle has a tapered portion between a bottle base and a bottle neck, and wherein the lowermost edge of the handle is aligned with the tapered portions of the bottles, slightly above narrowest diameter portions of the tapered portions of the bottles.

19. The tray of claim 18 further including a plurality of bottles in the tray, each bottle having a tapered portion between a bottle base and a bottle neck, wherein the lowermost edge of the handle is aligned with the tapered portions of the bottles, slightly above narrowest diameter portions of the tapered portions of the bottles.

20. A tray comprising:

a base;

a pair of opposed side walls extending along side edges of the base;

a pair of opposed end walls extending along end edges of the base;

a plurality of pockets defined on the base, each pocket for supporting a container;

hollow side columns along the side walls;

corner columns at corners of the tray; and an upper bar and a lower bar connecting adjacent pairs of the side columns and connecting side columns to corner columns.

21. The tray of claim 20 wherein the upper bar includes an inner wall from which an upper horizontal rib projects outwardly.

22. The tray of claim 21 wherein the upper bar further includes a lower horizontal rib projecting from the lower wall.

23. The tray of claim 22 wherein the lower horizontal rib is an arch.

24. The tray of claim 23 wherein the lower bar includes an outer wall and an inner wall extending downwardly from an upper wall.

* * * * *